US007894738B2

(12) United States Patent
Muraki

(10) Patent No.: US 7,894,738 B2
(45) Date of Patent: Feb. 22, 2011

(54) IMAGE RECORDING APPARATUS

(75) Inventor: Motohito Muraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 806 days.

(21) Appl. No.: 11/768,982

(22) Filed: Jun. 27, 2007

(65) Prior Publication Data

US 2008/0044197 A1 Feb. 21, 2008

(30) Foreign Application Priority Data

Jun. 29, 2006 (JP) ..... 2006-179283

(51) Int. Cl.
*G03G 15/00* (2006.01)

(52) U.S. Cl. ..... 399/81

(58) Field of Classification Search ..... 399/81, 399/107, 411

See application file for complete search history.

(56) References Cited

U.S. PATENT DOCUMENTS

| | | | | |
|---|---|---|---|---|
| 5,283,862 | A * | 2/1994 | Lund | 345/173 |
| 6,947,278 | B2 * | 9/2005 | Agata et al. | 361/679.07 |
| 2002/0021296 | A1 * | 2/2002 | Tsuji et al. | 345/418 |
| 2002/0158812 | A1 * | 10/2002 | Pallakoff | 345/5 |
| 2004/0207653 | A1 * | 10/2004 | Stavely et al. | 345/698 |
| 2004/0239808 | A1 * | 12/2004 | Oda et al. | 348/552 |
| 2004/0258274 | A1 * | 12/2004 | Brundage et al. | 382/100 |
| 2006/0280516 | A1 * | 12/2006 | Combs et al. | 399/81 |

FOREIGN PATENT DOCUMENTS

| | | | |
|---|---|---|---|
| JP | 10198291 | A | 7/1998 |
| JP | 2001184187 | A | 7/2001 |
| JP | 2002132099 | A | 5/2002 |
| JP | 2003035893 | A | 2/2003 |
| JP | 2003312088 | A | 11/2003 |
| JP | 2006150973 | A | 6/2006 |

* cited by examiner

*Primary Examiner*—David M Gray
*Assistant Examiner*—Rodney Bonnette
(74) *Attorney, Agent, or Firm*—Baker Botts L.L.P.

(57) ABSTRACT

An image recording apparatus, including: a main body; a display device including an image-display screen and pivotably provided in an outer surface of the main body so as to selectively take a closed posture in which the image-display screen is opposed to the main body and an open posture in which the image-display screen is visible; and an operable portion which includes a plurality of operable buttons provided on the outer surface of the main body, and which is configured such that a part of the plurality of operable buttons is disposed at a location where the part of the plurality of operable buttons is covered by the display device in the closed posture and such that an input operation by the part of the plurality of operable buttons is possible in relation to an image displayed on the image-display screen of the display device in the open posture.

11 Claims, 4 Drawing Sheets

IMAGE RECORDING APPARATUS

The present application is based on Japanese Patent Application No. 2006-179283 filed on Jun. 29, 2006, the contents of which are incorporated herein by reference.

BACKGROUND OF THE INVENTION

1. Field of the Invention

The present invention relates to a structure of an image recording apparatus and, more particularly, to a structure of an operation panel section including an operation button portion for inputting information such as characters and a display monitor on which images of characters, data, and the like can be displayed.

2. Description of the Related Art

Generally, an image recording apparatus, such as a printer, a copying machine, or a facsimile machine, includes an operation button portion for inputting commands for performing various functions of the apparatus, current states of the apparatus, and operational procedures and, in the image recording apparatus, an operation panel section including a display monitor such as a liquid crystal panel is disposed in an area easily usable to a user, e.g., a front portion of an upper surface of the apparatus, to notify the user of data and the like with respect to the commands, the current states of the apparatus, and the operational procedures inputted into the image recording apparatus. This structure is disclosed by J. P. A. Publication No. 2006-150973 or J. P. A. Publication No. 2003-035893.

Meanwhile, the image recording apparatus suffers from a problem that because the number of functions of the apparatus is increased, a required area of the operation button portion is increased and, on the other hand, because the number of data displayed on the display monitor is increased, it is difficult for the user to recognize the data unless the display monitor is large. Contradictorily, increasing the size of the operation panel section and consequently a main body of the apparatus to solve this problem does not meet a user's need, and another problem that a manufacturing cost and a distribution cost are also increased may occur.

SUMMARY OF THE INVENTION

The present invention has been developed to solve the above-described problems which are mutually contradictory, and it is an object of the present invention to provide an image recording apparatus in which a size of a display monitor can be increased without needing to increase a size of an operation panel section and consequently a main body of the apparatus and without needing to increase significantly an area required to dispose an operation button portion.

The object indicated above may be achieved according to the present invention which provides an image recording apparatus comprising: a main body; a display device including an image-display screen and pivotably provided in an outer surface of the main body so as to selectively take a closed posture in which the image-display screen is opposed to the main body and an open posture in which the image-display screen is visible; and an operable portion which includes a plurality of operable buttons provided on the outer surface of the main body, and which is configured such that a part of the plurality of operable buttons are disposed at a location where the part of the plurality of operable buttons are covered by the display device in the closed posture and such that an input operation by the part of the plurality of operable buttons is possible in relation to an image displayed on the image-display screen of the display device in the open posture.

In the image recording apparatus constructed as described above, a first area where the display device is disposed can be increased without needing to decrease a second area where the operable buttons of the operable portion are arranged in comparison with the case in which the first area and the second area are independent of each other.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Hereinafter, there will be described preferred embodiments of the present invention by reference to the drawings. It is to be understood that the following embodiments are described only by way of example, and the invention may be otherwise embodied with various modifications without departing from the scope and spirit of the invention.

An image recording apparatus as each of a first, a second, and a third embodiment of the present invention relates to a multi function device (MFD) 1 which has a printing function, a copying function, a scanning function, a facsimile function, and a cordless telephone function. The MFD 1 may be connected to a computer (not shown) or a telephone communication network, and can record an image or a text on a recording sheet as a sort of recording medium on the basis of image data or text data transmitted from the computer or a facsimile device. In addition, the MFD 1 may also be connected to an external device, such as a digital camera, and can record an image on a recording sheet on the basis of image data outputted from the external device.

Figure 1A:
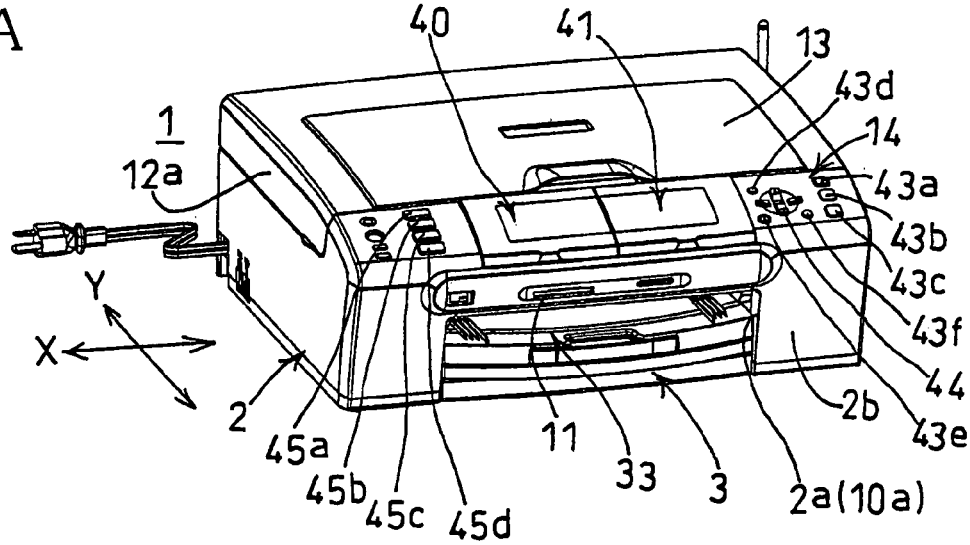
FIGS. 1A, 1B, and 1C are perspective views showing different states in which an image recording apparatus as a first embodiment of the present invention is used.
Figure 1B:
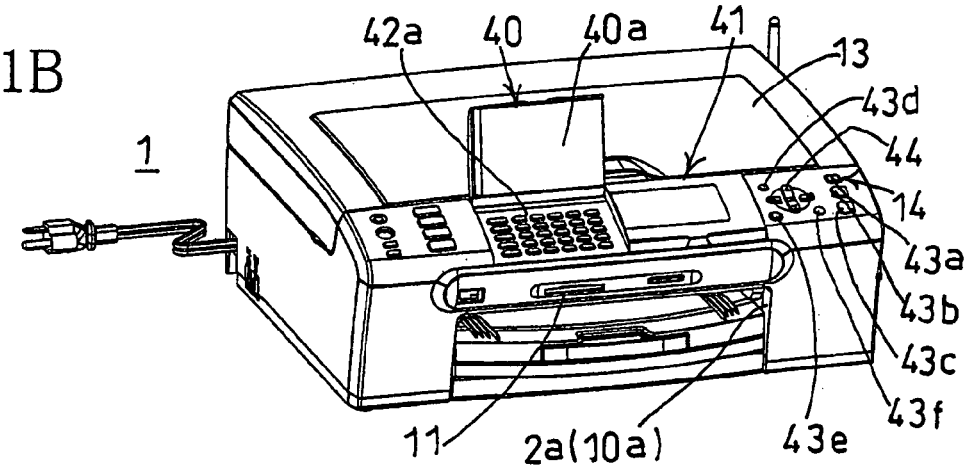
Figure 1C:
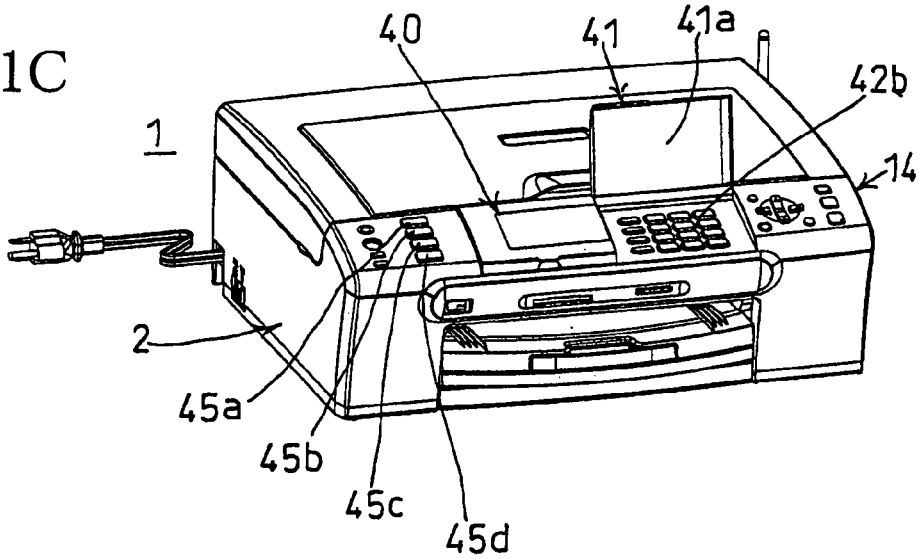
Figure 2:
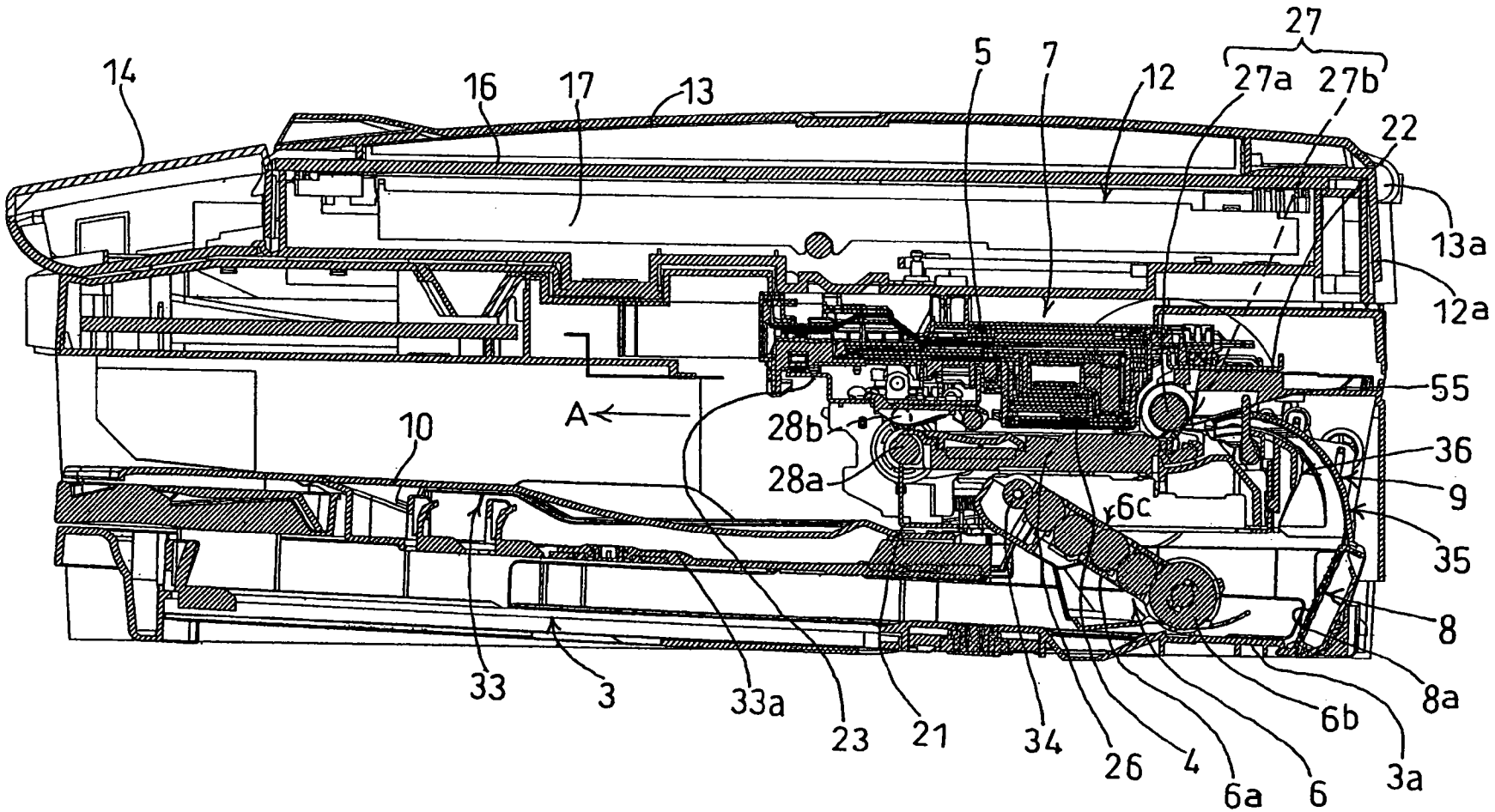
FIG. 2 is a transverse cross section view of the image recording apparatus as each of the first, a second and a third embodiment of the present invention.

In this MFD 1, as shown in FIGS. 1 and 2, an image-recording section (hereinafter, referred to as a "recording section") 7 is provided in a lower portion of a main casing (housing) 2 which is formed of a synthetic resin and which constitutes a part of an exterior of a main body of the apparatus. There are disposed a first sheet-supply cassette 3 and a second sheet-supply cassette 33 which are insertable into and removable from, in a generally horizontal direction, a cassette accommodating section (accommodating space) located in a bottom portion of the main casing 2, through an opening 2*a* open in a front portion of the main casing 2. In the following description, a side of the main casing 2 in which the opening 2*a* is open will be referred to as a "front side" or "front". In this connection, respective sides of the apparatus will be referred to as a "front side," "right and left sides," and a "back (rear) side." In the front portion of the main casing 2, there is provided a slot section 11 which is arranged such that various types of storage media, such as a memory card, is insertable therein. Images or the like can be recorded on the recording sheet on the basis of various data stored in a storage medium which is inserted in the slot section 11.

On the main casing 2, an image-reading device (scanning section) 12 for reading a document in the copying function or the facsimile function is disposed in an image-reading-device casing 12*a*.

On the main casing 2, an operation panel section (operable portion) 14 having various operation buttons or keys (operable buttons) which are manually operated, a liquid crystal display portion, and the like is provided in front of the image-reading device 12. There are disposed the recording section 7, a sheet-discharge section 10, and the like within a projected area of the image-reading device 12 and the operation panel section 14 in plan view. An ink-cartridge accommodating section (not shown) is provided on one side of the sheet-discharge section 10 (on the right side in FIG. 1) and in the front portion of the main casing 2. A front surface of the ink-cartridge accommodating section is covered by a lid member 2*b* which is pivotably attached, at a lower end thereof, to the front portion of the main casing 2 via a hinge so as to be opened and closed.

In an upper surface of the image-reading device 12, there is provided a glass plate 16 on which a document is placed. Under the glass plate 16, there is provided an image scanner device (CIS: Contact Image Sensor) 17 for reading a document, such that the CIS 17 can reciprocate in directions perpendicular to the sheet surface of FIG. 2 (in a main scanning direction, hereinafter, referred to as an X-axis direction).

A document covet 413 covering the glass plate 16 is attached, at a rear end portion thereof (in a right portion in FIG. 2), to the image-reading-device casing 12*a* via a hinge 13*a* so as to be opened and closed.

As shown in FIG. 2, the recording section 7 includes: first and second guide members 22, 23 which are supported by a pair of right and left side plates (not shown) that constitute a main frame 21 opening upward and each of which has an elongate plate-like shape extending in the X-axis direction (in the main scanning direction); a reciprocable carriage 5 which bridges the first and second guide members 22, 23 such that the carriage 5 is slidably supported by or mounted on the same 22, 23; a timing belt (not shown), serving as an endless belt, which is disposed above an upper surface of the second guide member 23 such that the timing belt extends parallel to the same 23, and which is wound around pulleys to reciprocate the carriage 5 on which a recording head 4 is mounted; a CR (carriage) motor (not shown) by which the timing belt is driven (a DC motor is used in this MFD 1, but other motors, such as a stepper motor, may be used); a plate-like platen 26 which is provided below a lower surface of the recording head 4 and supports a recording sheet P being fed; a tape scale (not shown) which is provided for detecting a position and a moving speed of the carriage 5 in the X-axis direction (in the main scanning direction), which is a component of an optical linear encoder, and which is disposed so as to extend in the main scanning direction; and the like. It is noted that the first guide member 22 is disposed upstream in a sheet feeding direction (in a direction indicated by arrow A, shown in FIG. 2) in which the sheet P is fed over the platen 26, while the second guide member 23 is disposed downstream in the sheet feeding direction.

A pair of sheet-register rollers 27 having a carrying function and a registering function are disposed on an upstream side of the platen 26 in the sheet feeding direction. The pair of sheet-register rollers 27 constituted by a driving roller 27*a* and a driven roller 27*b* feed the sheet P into a gap between the platen 26 and a nozzle surface which is the lower surface of the recording head 4. On a downstream side of the platen 26 in the sheet feeding direction, there are disposed a spur 28*b* which is to be contacted with an upper surface of the sheet P and a sheet-discharge roller 28*a* which is driven or rotated on a lower surface of the sheet P. The sheet-discharge roller 28*a* and the spur 28*b* feed the sheet P on which an image has been recorded, to the sheet-discharge section 10.

In this MFD 1, as shown in FIG. 2, the first sheet-supply cassette 3 includes an accommodating portion 3*a* which can accommodate a stack of sheets of selected one of large sizes, such as an A3 size, an A4 size, a letter size, and a legal size, such that a short side of the sheet extends in the main scanning direction (in the X-axis direction, i.e., a direction perpendicular to the sheet surface of FIG. 2). On the first sheet-supply cassette 3, there is mounted the second sheet-supply cassette 33 including a sheet-placing portion 33*a* which can accommodate a stack of sheets of selected one of small sizes, such as a postcard. Further, right and left end portions of a bottom plate of the second sheet-supply cassette 33 are slidably contacted with respective upper end surfaces of right) and left side plates of the first sheet-supply cassette 3, thereby permitting the second sheet-supply cassette 33 to be moved in a Y-axis direction (in the sheet feeding direction, i.e., a sub scanning direction).

On a back portion of the first sheet-supply cassette 3 (on a downstream portion in the sheet feeding direction, i.e., on a right side in FIG. 2), an inclined sheet-separate plate 8 is disposed for separating the sheets. On the other hand, the main casing 2 supports a sheet-supply roller 6*b* as a part of sheet-supply means 6. More specifically, a drive shaft 34 is provided in an upper end portion of a sheet-supply arm 6*a* as another part of sheet-supply means 6, and the sheet-supply arm 6*a* is mounted so as to be pivotable upward and downward about the drive shaft 34. The sheet-supply roller 6*b* is provided at a lower end of the sheet-supply arm 6*a* which supports a gear transmission mechanism 6*c*. The sheet-supply roller 6*b* cooperates with an elastic pad 8*a* (e.g., a leaf spring in this MFD 1) as separate means provided in the sheet-separate plate 8 so as to separate and feed, one by one, the sheets P stacked in the first sheet-supply cassette 3 and the second sheet-supply cassette 33.

The separated sheet P is supplied to the recording section 7 provided above the first sheet-supply cassette 3 via a U-turn path (a sheet-supply path) 9 which is curved upward and frontward. The U-turn path 9 is given by an appropriate space that is defied between an outer feed-path-defining member 35 which has a generally U-shaped cross section and an inner feed-path-defining member 36 which is disposed radially inside the outer feed-path-defining member 35. Above the second sheet-supply cassette 33, there is provided the sheet-discharge section (a sheet-discharge tray section) 10 to which the sheet P recorded in the recording section 7 is discharged with its recorded surface upward and which communicates with a sheet-discharge opening (an upper portion of the opening 2*a*, as shown in FIG. 1) 10*a* open in the front surface of the main casing 2.

As shown in FIG. 2, on a downstream side of the sheet-supply path (the U-turn path) 9 in the sheet feeding direction, there is pivotably provided a detection lever 55, as a part of a sheet presence/absence detecting sensor, which extends radially outward from an area radially inside the inner feed-path-defining member 36, thereby detecting passages of leading and trailing edges of each sheet P passing through the sheet-supply path 9.

Next, there will be explained a structure of the operation panel section 14 of the MFD 1 in greater detail. The first embodiment is shown in FIGS. 1A-1C. In a middle portion of the operation panel section 14 which is elongate in the X-axis direction (i.e., a rightward and leftward direction), left and right display monitors 40, 41 each as a display device and each of which is of a liquid crystal panel type are disposed such that two display monitors 40, 41 are pivotable in the same direction independently of each other so as to be opened, and are pivotable in the same direction independently of each other so as to be closed. That is, the left and right display monitors 40, 41 are pivotably supported, independently of each other, at their rear end portions thereof via respective hinges, such that respective pivotal axes of the display monitors 40, 41 are coincidental with each other. As shown in FIG. 1A, when the two display monitors 40, 41 are closed, i.e., when the two display monitors 40, 41 take respective closed postures in which the two display monitors 40, 41 are laid down, respective image-display screens 40*a*, 41*a* thereof face downward. As shown in FIGS. 1B and 1C, when one of the two display monitors 40, 41 is opened, i.e., when one of the two display monitors 40, 41 takes an open posture in which the one display monitor 40, 41 is raised up, a corresponding one of the image-display screens 40*a*, 41*a* faces frontward.

As shown in FIGS. 1B and 1C, two operation button portions 42*a*, 42*b* having predetermined respective functions are disposed in respective areas that are hidden by, and opposed to, the respective image-display screens 40*a*, 41*a* of the two display monitors 40, 41 in the respective closed postures. It is noted that, in this MFD 1, a plurality of first operable buttons constituting the operation button portion 42*a* functions as a first part of the plurality of operable buttons, and the left display monitor 40 functions as a first display device. In this connection, a plurality of second operable buttons constituting the operation button portion 42*b* functions as a second part of the plurality of operable buttons, and the right display monitor 41 functions as a second display device. In the illustrated embodiment, the operation button portion 42*a* corresponding to the left display monitor 40 is constituted by the plurality of first operation buttons for inputting alphabetic characters and the like and for changing sorts of characters, while the operation button portion 42*b* corresponding to the right display monitor 41 is constituted by the plurality of second operation buttons (i.e., numeric keys) for inputting numeric characters. These operation button portions 42*a*, 42*b* are used in operations such as an operation for inputting a destination facsimile number, an operation for inputting a name of a person or a company, and the like when an abbreviated number is registered, and an operation for setting system preferences. Thus, the operation button portions 42*a*, 42*b* do not have a high frequency in an input operation.

Further, two operation button portions having a high frequency in the input operation are provided in right and left outside areas located on right and left outsides of the two display monitors 40, 41, and a plurality of third operable buttons constituting the two operation button portions functions as a third part of the plurality of operable buttons. That is, the third operable buttons are disposed at a location where the operable buttons are not covered by the display monitors 40, 41. It is noted that at least one of the third operable buttons is operated at a higher frequency than each of the operable buttons of the first and second parts. In the illustrated embodiment, in the right outside area, there are arranged a power on/off button 43*a*, a color operation start button 43*b*, and a monochrome operation start button 43*c* in a frontward and backward direction, and on their left side, there are arranged select buttons 44 for scrolling respective images on the image-display screens 40*a*, 41*a*, an OK button 43*d*, a clear button 43*e*, and a menu button 43*f*. In the left outside area, there are arranged function selecting buttons such as a digital camera print button 45*a*, a copy button 45*b*, a fax button 45*c*, and a scan buttons 45*d*. It is noted that one of the color operation start button 43*b* and the monochrome operation start button 43*c* is pushed for selecting a color image recording operation or a monochrome image recording operation when a function corresponding to the print button 45*a*, the copy button 45*b*, the fax button 45*c*, or the scan button 45*d* is performed by operating one of these buttons.

In this first embodiment, in a stand-by condition of the MFD 1 after one of the functions such as the facsimile function, the printing function, and the copying function is selected, as shown in FIG. 1A, both of the left and right display monitors 40, 41 are laid down (closed), thereby preventing the operation button portions 42*a*, 42*b* which do not have the high frequency, from being covered with dust. Further, as described above, each of the operation button portions 42*a*, 42*b* is opposed to a corresponding one of the image-display screens 40*a*, 41*a* in the respective closed postures, but each operation button portion 42*a*, 42*b* is visible and can be operated by the user when the corresponding display monitor 40, 41 is in the open posture. More specifically, each of the first and second parts of the plurality of operable buttons is disposed at a location where the each part is covered by a corresponding one of the display monitors 40, 41 in the closed postures, and the input operation by the each part is possible in relation to an image displayed on a corresponding one of the image-display screens 40*a*, 41*a* in the open postures. In this MFD 1, when each display monitor 40, 41 is in the open posture, an image according to the input operation of the corresponding operation button portion 42*a*, 42*b* located in the area of the operation panel section 14 corresponding to the each opened display monitor 40, 41 is displayed on the corresponding image-display screen 40*a*, 41*a* of the each opened display monitor 40, 41. Therefore, a first area where the display monitors 40, 41 are disposed can be increased without needing to decrease a second area where the operation button portions 42*a*, 42*b* are arranged in comparison with the case in which the first area and the second area are independent of each other.

Figure 3A:
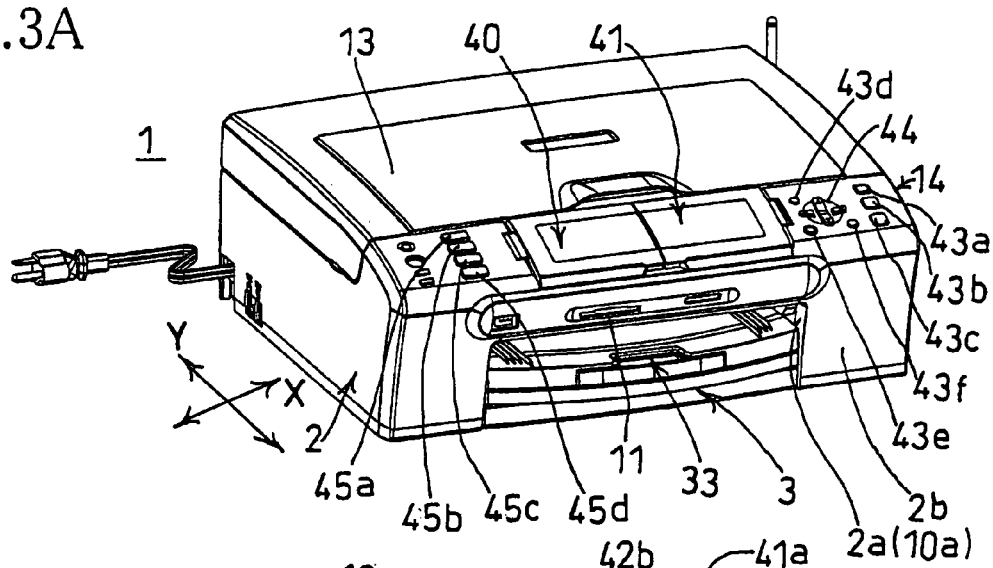
FIGS. 3A, 3B, and 3C are perspective views showing different states in which an image recording apparatus as the second embodiment of the present invention is used.
Figure 3B:
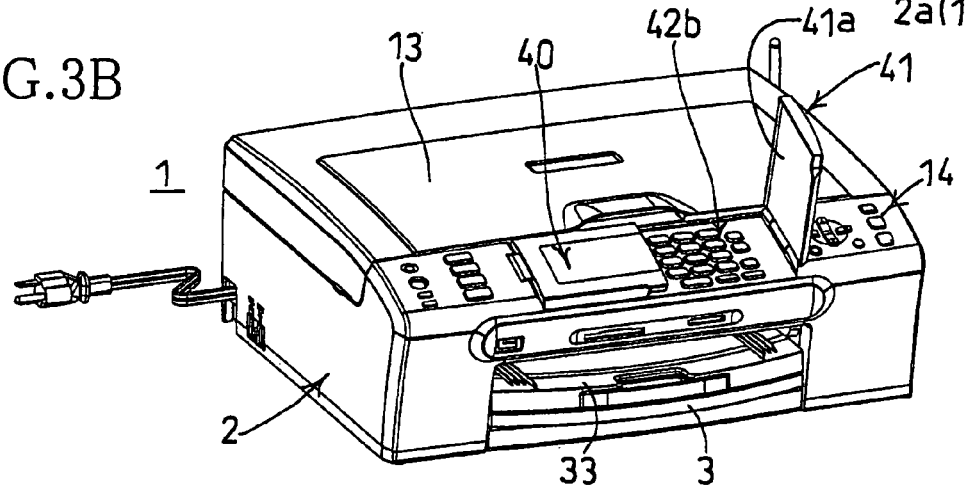
Figure 3C:
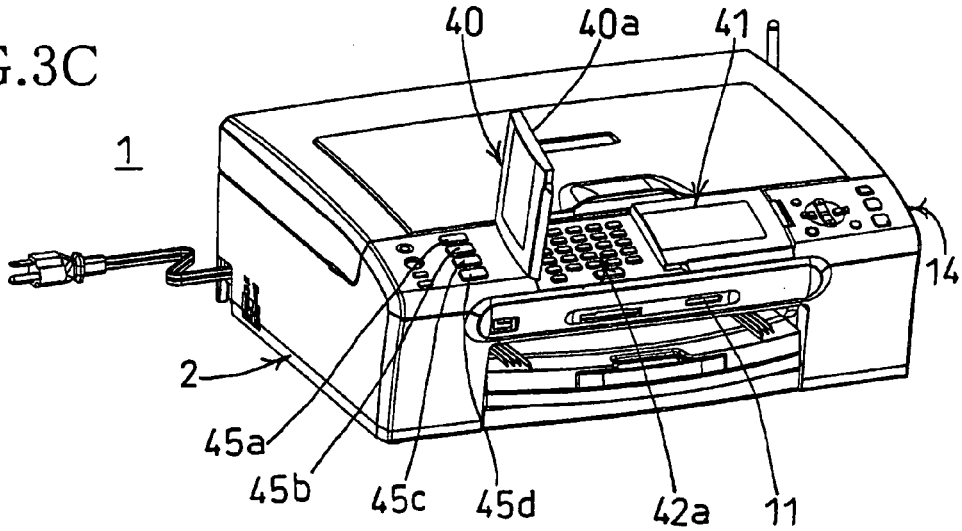

The second embodiment is shown in FIGS. 3A-3C, and the left and right display monitors 40, 41 are arranged in a double door configuration so as to be pivotably opened and closed. In other words, each one of the two display monitors 40, 41 is pivotable about one of opposite end portions thereof which is remoter from the other of the display monitors 40, 41 than the other of the opposite end portions, and the display monitors 40, 41 are provided such that respective pivotal axes thereof are parallel to each other. That is, the left display monitor 40 is pivotably supported at a left end portion thereof on the operation panel section 14, while the right display monitor 41 is pivotably supported at a right end portion thereof on the operation panel section 14. Each display monitor 40, 41 is provided so as to be pivotable by about 180 degrees from the closed posture in which the corresponding image-display screen 40*a*, 41*a* faces downward, to the open posture in which the same 40*a*, 41*a* faces upward. Because the other structure of the operation panel section 14 (i.e., the types and arrangements of the keys or the operable buttons) is the same as that of the first embodiment, the same reference numerals as used in the first embodiment are used and a detailed explanation of the other structure is not given. As in the first embodiment, in this second embodiment, both of the left and right display monitors 40, 41 are laid down (closed), thereby preventing the operation button portions 42*a*, 42*b* which do not have the high frequency, from being covered with dust. Further, if the MFD 1 is configured such that when each display monitor 40, 41 is in the open posture, an image according to the input operation of the corresponding operation button portion 42*a*, 42*b* located in the area of the operation panel section 14 corresponding to the each opened display monitor 40, 41 is displayed on the corresponding image-display screen 40*a*, 41*a* of the each opened display monitor 40, 41, the first area where the display monitors 40, 41 are disposed can be increased without needing to decrease the second area where the operation button portions 42*a*, 42*b* are arranged in comparison with the case in which the first area and the second area are independent of each other.

In the first and second embodiments, the display monitors 40, 41 are arranged side by side in the respective closed postures, and are pivotable in the same direction (in the first embodiment) or in opposite directions (in the second embodiment) from the respective closed postures to the respective open postures. Thus, an operability of the image recording apparatus can be improved in accordance with the user's demand only by changing the directions of pivotal axes of the display monitors 40, 41.

Figure 4A:
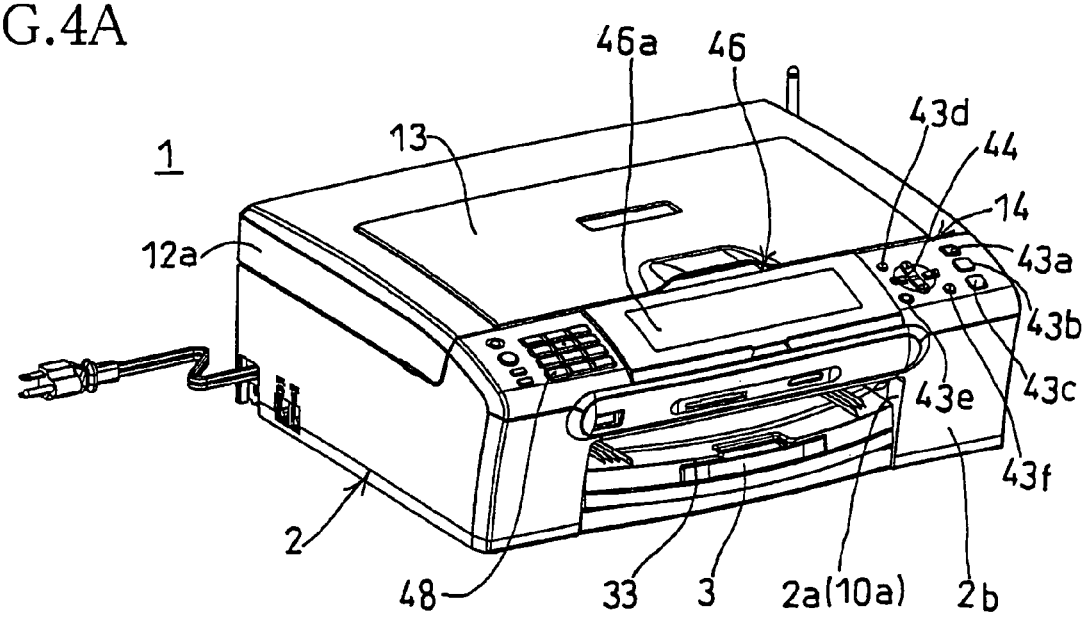
FIGS. 4A and 4B are perspective views showing different states in which an image recording apparatus as the third embodiment of the present invention is used.
Figure 4B:
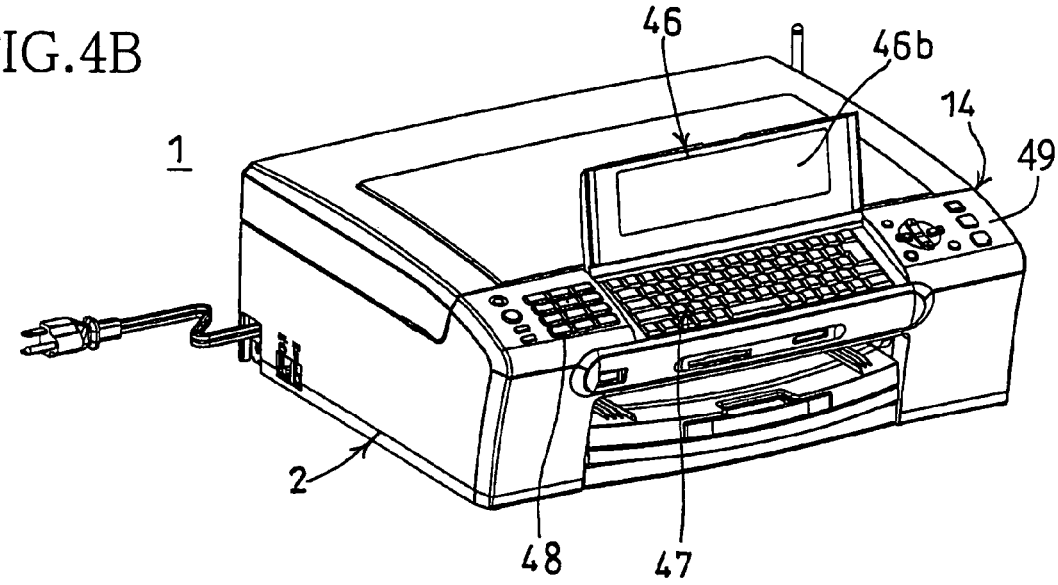

FIGS. 4A and 4B show the third embodiment. In this embodiment, a display monitor 46 which is elongate in the rightward and leftward direction is supported at a rear end portion thereof via hinges on the operation panel section 14. The display monitor 46 includes outer and inner image-display screens 46*a*, 46*b* in outer and inner surfaces thereof, respectively. That is, when the display monitor 46 is closed, i.e., takes a closed posture in which the display monitor 46 is laid down, as shown in FIG. 4A, the outer image-display screen 46*a* in the outer surface of the display monitor 46 faces upward, while the inner image-display screen 46*b* in the inner surface of the display monitor 46 faces downward. When the display monitor 46 is opened, i.e., takes an open posture in which the display monitor 46 is raised up, as shown in FIG. 4*b*, the inner image-display screen 46*b* faces frontward.

As shown in FIG. 4B, an operation button portion 47 including a plurality of operable buttons each having a predetermined function is disposed in an area of the operation panel section 14 that is covered by the display monitor 46 in the closed posture and is opposed to the inner image-display screen 46*b* thereof. It is noted that, in this third embodiment, the plurality of the operable buttons constituting the operation button portion 47 functions as a first part of the plurality of operable buttons, and the outer and inner image-display screens 46*a*, 46*b* function as a second and a first image-display screen, respectively. That is, the second image-display screen is provided behind the first image-display screen so as to be visible in the closed posture of the display monitor 46. In the illustrated embodiment, the operation button portion 47 is constituted by a plurality of operation buttons for inputting characters such as alphabetic characters, and for changing sorts of characters. The operation button portion 47 is used in operations such as an operation for inputting a name of a person or a company, and the like when an abbreviated number is registered, and an operation for setting system preferences. Thus, the operation button portion 47 does not have the high frequency in the input operation. Further, an operation button portion 48 disposed in an area of the operation panel section 14 located on a left outside of the display monitor 46 includes a plurality of operation buttons (numeric keys) for inputting numeric characters, while an operation button portion 49 is disposed in an area of the operation panel section 14 located on a right outside of the display monitor 46, and in the operation button portion 49, there are arranged the power on/off button 43*a*, the color operation start button 43*b*, and the monochrome operation start button 43*c* in the frontward and backward direction, and on the left side of these buttons, there are arranged the select buttons 44 for scrolling an image and the like on the image-display screens 46*a*, 46*b*, the OK button 43*d*, the clear button 43*e*, and the menu button 43*f*. It is noted that a plurality of operable buttons arranged in the operation button portions 48, 49 functions as a third part of the plurality of operable buttons, and at least-one operable button of the third part is operated at a higher frequency than each of the operable buttons of the first part.

In this third embodiment, when the display monitor 46 is in the closed posture, the operation button portion 49 for inputting numeric characters, the power on/off button 43*a*, the color operation start button 43*b*, or the monochrome operation start button 43*c* each having the high frequency in the input operation can be used, and respective signs of these buttons and a respective states in which functions of these buttons are performed can be displayed on the outer image-display screen 46*a*, because the outer image-display screen 46*a* faces upward. On the other hand, when the display monitor 46 is in the open posture, the operation button portions 48, 49 each having the high frequency in the input operation can be used and the operation button portion 47 which had been covered is disclosed, whereby an image and the like according to the input operation of the operation button portion 47 can be displayed on the inner image-display screen 46*b*.

In each of the above-described embodiments, even though the area where the operable buttons of the operation button portion 47 are arranged is increased, the display monitor itself can be enlarged. Therefore, the enlarged display monitor can be disposed, while the operable buttons can be arranged in the operation panel section 14 whose area has a limit. Further, an operability of the image recording apparatus can be improved, without the apparatus being enlarged. Furthermore, the operation button portion having the high frequency in the input operation is not covered by the display monitor which is pivotably opened and closed, thereby still improving the operability of the image recording apparatus.

What is claimed is:

1. An image recording apparatus, comprising:

a main body;

a display device including an image-display screen and pivotably provided on an outer surface of the main body so as to selectively take a closed posture in which the image-display screen is opposed to the main body and an open posture in which the image-display screen is visible;

an operable portion which includes a plurality of operable buttons provided in the outer surface of the main body, and which is configured such that a first part of the plurality of operable buttons is disposed at a location where the first part of the plurality of operable buttons is covered by the display device in the closed posture and such that an input operation by the first part of the plurality of operable buttons is possible in relation to an image displayed on the image-display screen of the display device in the open posture; and a second display device, in addition to the display device as a first display device, including an image-display screen and pivotably provided on the outer surface of the main body so as to selectively take a closed posture in which the image-display screen is opposed to the main body and an open posture in which the image-display screen is visible, wherein the operable portion is configured such that a second part which is a different part of the plurality of operable buttons from the first part of the plurality of operable buttons is disposed at a location where the second part is covered by the second display device in the closed posture, and such that an input operation by the second part is possible in relation to an image displayed on the image-display screen of the second display device in the open posture.

2. The image recording apparatus according to claim 1, wherein the first display device and the second display device are arranged side by side in the respective closed postures.

3. The image recording apparatus according to claim 2, wherein the first display device and the second display device are pivoted in a same direction from the respective closed postures to the respective open postures.

4. The image recording apparatus according to claim 2, wherein each one of the first display device and the second display device is pivotable about one of opposite end portions thereof which is remoter from the other of the first display device and the second display device than the other of the opposite end portions.

5. The image recording apparatus according to claim 2, wherein the first display device and the second display device are provided such that respective pivotal axes thereof are parallel to, or coincidental with, each other.

6. The image recording apparatus according to claim 1, wherein the operable portion is configured such that a third part which is a different part of the plurality of operable buttons from the first part and the second part is disposed at a location where the third part is not covered by the first display device and the second display device.

7. The image recording apparatus according to claim 6, wherein the third part includes at least one operable button which has a high frequency.

8. The image recording apparatus according to claim 7, wherein the at least one operable button of the third part is operated at a higher frequency than each of operable buttons of the first and second parts.

9. An image recording apparatus, comprising:

a main body;

a display device including an image-display screen and pivotably provided on an outer surface of the main body so as to selectively take a closed posture in which the image-display screen is opposed to the main body and an open posture in which the image-display screen is visible; and an operable portion which includes a plurality of operable buttons provided in the outer surface of the main body, and which is configured such that a part of the plurality of operable buttons is disposed at a location where the part of the plurality of operable buttons is covered by the display device in the closed posture and such that an input operation by the part of the plurality of operable buttons is possible in relation to an image displayed on the image-display screen of the display device in the open posture, wherein the operable portion includes a third part which is a different part of the plurality of operable buttons from the part of the plurality of operable buttons as a first part, wherein the third part is not covered by the display device where the display device is in the closed posture, wherein the third part includes, as ones of the plurality of operable buttons of the operable portion, a plurality of operable buttons, at least one of which is disposed on each of opposite sides of the first part in a longitudinal direction of the display device, wherein the third part includes at least one operable button which has a high frequency, wherein the at least one operable button of the third part is operated at a higher frequency than each of the operable buttons of the first part, wherein the at least one operable button of the third part which is operated at the higher frequency includes a power button for turning on and off a main power of the image recording apparatus and buttons for inputting numbers, and wherein the first part includes operable buttons for inputting characters.

10. The image recording apparatus according to claim 9, wherein the power button is located on a right side of the first part while the buttons for inputting the numbers are located on a left side of the first part.

11. An image recording apparatus, comprising:

a main body;

a display device including an image-display screen and pivotably provided on an outer surface of the main body so as to selectively take a closed posture in which the image-display screen is opposed to the main body and an open posture in which the image-display screen is visible; and an operable portion which includes a plurality of operable buttons provided in the outer surface of the main body, and which is configured such that a part of the plurality of operable buttons is disposed at a location where the part of the plurality of operable buttons is covered by the display device in the closed posture and such that an input operation by the part of the plurality of operable buttons is possible in relation to an image displayed on the image-display screen of the display device in the open posture, wherein the operable portion includes a third part which is a different part of the plurality of operable buttons from the part of the plurality of operable buttons as a first part, wherein the third part is not covered by the display device where the display device is in the closed posture, wherein the third part includes, as ones of the plurality of operable buttons of the operable portion, a plurality of operable buttons, at least one of which is disposed on each of opposite sides of the first part in a longitudinal direction of the display device, and wherein the first part and the third part have the same length in a direction perpendicular to a longitudinal direction of the display device.

* * * * *